US007263301B2

(12) United States Patent
Martin et al.

(10) Patent No.: US 7,263,301 B2
(45) Date of Patent: Aug. 28, 2007

(54) INLINE PURGE CAPABILITY (PURGE WHILE RUN) TO IMPROVE SYSTEM PRODUCTIVITY DURING LOW AREA COVERAGE RUNS

(75) Inventors: Michael J. Martin, Hamlin, NY (US); Robert M. Mara, Fairport, NY (US); Richard L. Forbes, II, Pittsford, NY (US); Charles A. Barbe, III, Rochester, NY (US); Joseph A. Mastrandrea, Webster, NY (US)

(73) Assignee: Xerox Corporation, Stamford, CT (US)

( * ) Notice: Subject to any disclaimer, the term of this patent is extended or adjusted under 35 U.S.C. 154(b) by 248 days.

(21) Appl. No.: 11/120,342

(22) Filed: May 3, 2005

(65) Prior Publication Data

US 2005/0286917 A1 Dec. 29, 2005

Related U.S. Application Data

(60) Provisional application No. 60/582,481, filed on Jun. 24, 2004.

(51) Int. Cl.
*G03G 15/08* (2006.01)

(52) U.S. Cl. ..... 399/27; 399/72

(58) Field of Classification Search ..... 399/49, 399/72, 27
See application file for complete search history.

(56) References Cited

U.S. PATENT DOCUMENTS

| | | | | |
|---|---|---|---|---|
| 5,122,835 | A * | 6/1992 | Rushing et al. | 399/49 |
| 5,710,958 | A * | 1/1998 | Raj | 399/49 |
| 6,167,213 | A | 12/2000 | Buranicz et al. | |
| 6,167,214 | A | 12/2000 | Scheuer et al. | |
| 6,169,861 | B1 | 1/2001 | Hamby et al. | |
| 6,175,698 | B1 | 1/2001 | Scheuer et al. | |
| 6,201,937 | B1 * | 3/2001 | Folkins | 399/49 |
| 6,404,997 | B1 | 6/2002 | Grace | |
| 6,505,832 | B2 | 1/2003 | Moore et al. | |
| 6,790,573 | B2 | 9/2004 | Drappel et al. | |

FOREIGN PATENT DOCUMENTS

JP 2003149952 A * 5/2003

* cited by examiner

*Primary Examiner*—Susan Lee

(57) ABSTRACT

A method controlling toner age in a developer housing including: recording a latent image in a predefined image frame on an imaging surface; and generating a purge patch in an unused portion of the predefined image frame. Other features include generating an inline purge signal to initiate generating of the purge patch; recording the purge patch includes scaling the purge patch to fit in the unused portion of the predefined image frame; activating or inactivating the generating of the purge patch based upon an amount of unused portion of the image frame.

16 Claims, 4 Drawing Sheets

INLINE PURGE CAPABILITY (PURGE WHILE RUN) TO IMPROVE SYSTEM PRODUCTIVITY DURING LOW AREA COVERAGE RUNS

CROSS REFERENCE TO RELATED APPLICATIONS

This application claims the benefit of Provisional Patent Application No. 60/582,481, filed Jun. 24, 2004.

BACKGROUND

The present invention generally relates to a digital imaging system. More specifically, the present invention provides an improved method and apparatus for maintaining toner age to ensure image quality by anticipating or diagnosing problems in image quality, which may be caused by toner age.

INCORPORATED BY REFERENCE

The following is specifically incorporated by reference: U.S. Pat. Nos. 6,404,997; 6,175,698; 6,169,861; 6,167,214; 6,167,213 and 6,790,573.

Modern electronic copiers, printers, facsimile machines, etc. are capable of producing complex and interesting page images. The pages may include text, graphics, and scanned or computer-generated images. The image of a page may be described as a collection of simple image components or primitives (characters, lines, bitmaps, colors, etc.). Complex pages can then be built by specifying a large number of the basic image primitives. This is done in software using a page description language such as POSTSCRIPT™. The job of the electronic printer's software is to receive and interpret each of the imaging primitives for the page. The drawing, or rasterization must be done on an internal, electronic model of the page. All image components must be collected and the final page image must be assembled before marking can begin. The electronic model of the page is often constructed in a data structure called an image buffer. The data contained is in the form of an array of color values called pixels. Each actual page and the pixel's value provide the color which should be used when marking. The pixels are organized to reflect the geometric relation of their corresponding spots. They are usually ordered to provide easy access in the raster pattern required for marking.

In the prior art, a copier, printer or other document-generating device typically employs an initial step of charging a photoconductive member to substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member, which is subsequently transferred to a copy sheet. The copy sheet having the toner image thereon is then advanced to a fusing station for permanently affixing the toner image to the copy sheet.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of develop ability and electrostatics. Electrostatic voltages are measured using a sensor such as an Electrostatic Voltmeter (ESV). Develop ability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and develop ability is affected by other variables such as ambient temperature, humidity and the age of the toner. For example, a three-percent TC results in different develop abilities depending on the variables listed above. Therefore, in order to ensure good develop ability, which is necessary to provide high quality images, toner age must be considered.

Consequently, there is a need to provide a method and apparatus for calculating or determining toner age to ensure image quality by anticipating or diagnosing problems in image quality, which may be caused by toner age. These problems include low develop ability, high background, and halo defects appearing on sheets of support material. One method of managing the residence time of toner in the developer housing is to use a minimum area coverage (MAC) patch in the inter-page zone to cause a minimum amount of toner throughput which is disclosed in U.S. Pat. No. 6,047,142 which is hereby incorporated by reference.

As taught in that patent, during low area coverage runs, the development and transfer systems are stressed beyond their operating limits resulting color drift, streaks, and development loss. The initial xerographic control implementation included a Minimum Area Coverage (MAC) patch algorithm. The minimum throughput is determined by calculating the average residence time of the toner in the development housing and is referred to as the toner age. The MAC patch algorithm starts printing patches in the IDZ whenever the toner age reaches an upper limit and then stops printing when the toner age reached a lower limit. It has been found that there are instances when the MAC patch algorithm's capability is insufficient to maintain material health during extended low area coverage runs, requiring additional material management control schemes to maintain adequate development and transfer performance. Consequently the auto toner purge algorithm (ATP) is implemented to better manage the material state during low area coverage. With auto toner purge enabled, the system will enter a dead cycle whenever the toner age exceeds an upper limit. The ATP routine will develop a predetermine number of high area coverage patches to cause the developer sump to be refreshed with new toner. The routine takes between 3 and 4 minutes to complete. This routine has been shown to be very effective at maintaining development and transfer performance during long runs of low area coverage. However, in order to maintain the system performance during low area coverage runs, the system requires frequent ATPs. A major drawback to auto toner purge mode is that the print productivity of the printing machine is substantially reduced as a result of image frames being lost in the dead cycle, for example, it has been found that the average machine performs an ATP dead cycle every 2500 images. The productivity impact of the ATP dead cycle can be as great as 15%, thereby reducing the 100 ppm print engine to approximately 85 ppm.

SUMMARY

Briefly, in the present invention, the impact of the above problems is significantly reduced and the overall machine productivity is increased by provided a method controlling toner age in a developer housing including: recording a latent image in a predefined image frame on an imaging surface; and generating a purge patch in an unused portion of said predefined image frame. Other features include generating an inline purge signal to initiate generating of said purge patch; recording said purge patch includes scaling the purge patch to fit in the used portion of said predefined image frame; activating or inactivating the generating of the purge patch based upon an amount of unused portion of said image frame.

DETAILED DESCRIPTION

Figure 1:
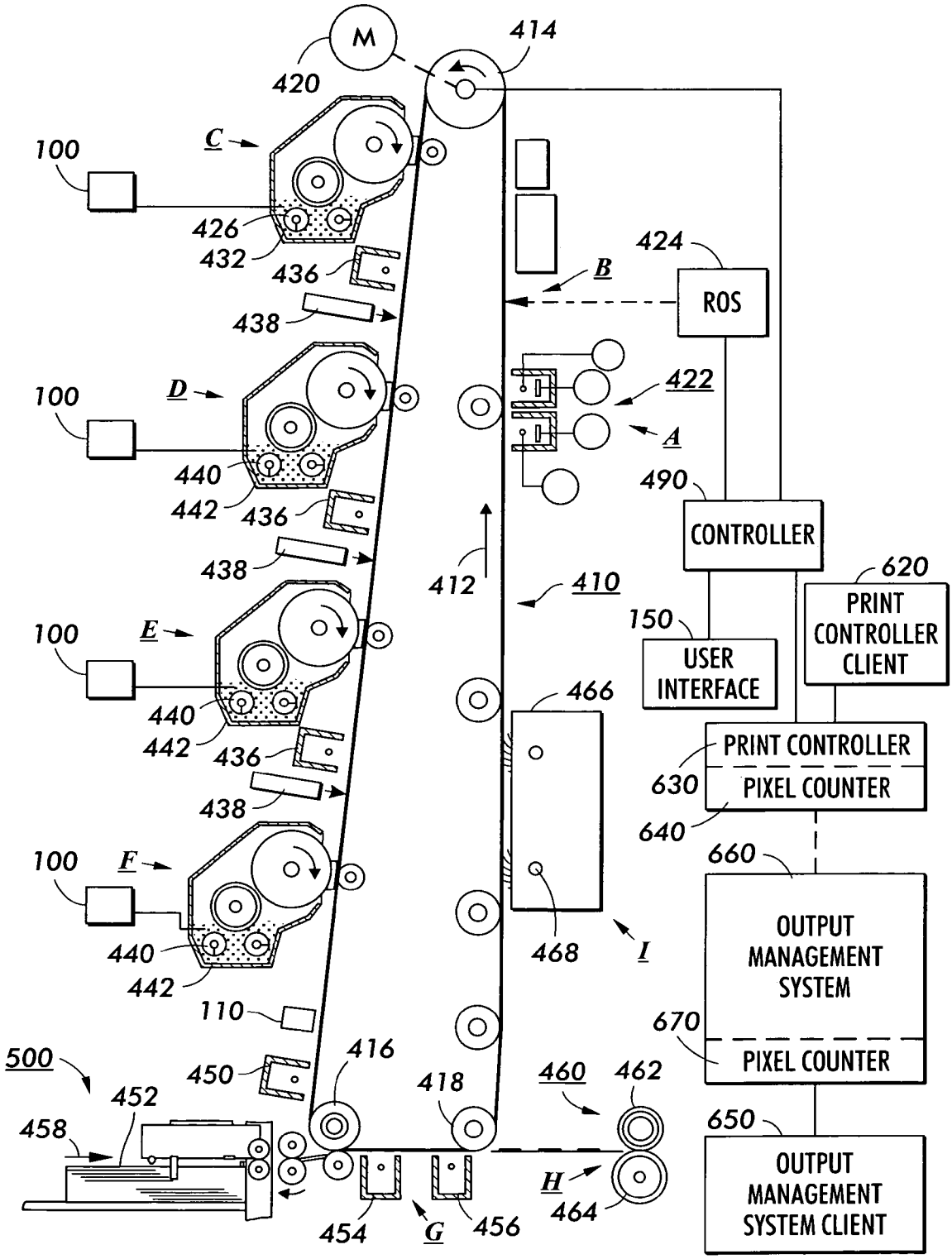
FIG. 1 is a partial schematic of an example of a print engine for a digital imaging system, which can employ the purge while run process of the present invention.

FIG. 1 is a partial schematic view of a digital imaging system, such as the digital imaging system of U.S. Pat. No. 6,505,832 which is hereby incorporated by reference. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

In this embodiment, printing jobs are submitted from the Print Controller Client 620 to the Print Controller 630. A pixel counter 640 is incorporated into the Print Controller to count the number of pixels to be imaged with toner on each sheet or page of the job, for each color. The pixel count information is stored in the Print Controller memory. Job control information, including the pixel count data, and digital image data are communicated from the Print Controller 630 to the Controller 490. The digital image data represent the desired output image to be imparted on at least one sheet.

FIG. 1 additionally shows an alternative embodiment in which an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490. In this alternative embodiment, pixel counting in the Print Controller 630 is not necessary since the data has been provided with the job control information from the Output Management System 660.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage $V_0$, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the developer roller, better known as the donor roller, is powered by two developer fields (potentials across an air gap). The first field is the ac field which is used for toner cloud generation. The second field is the dc developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets. The steps in the flow chart in FIG. 2 are repeated for each developer in FIG. 1 to measure the toner age.

Figure 2:
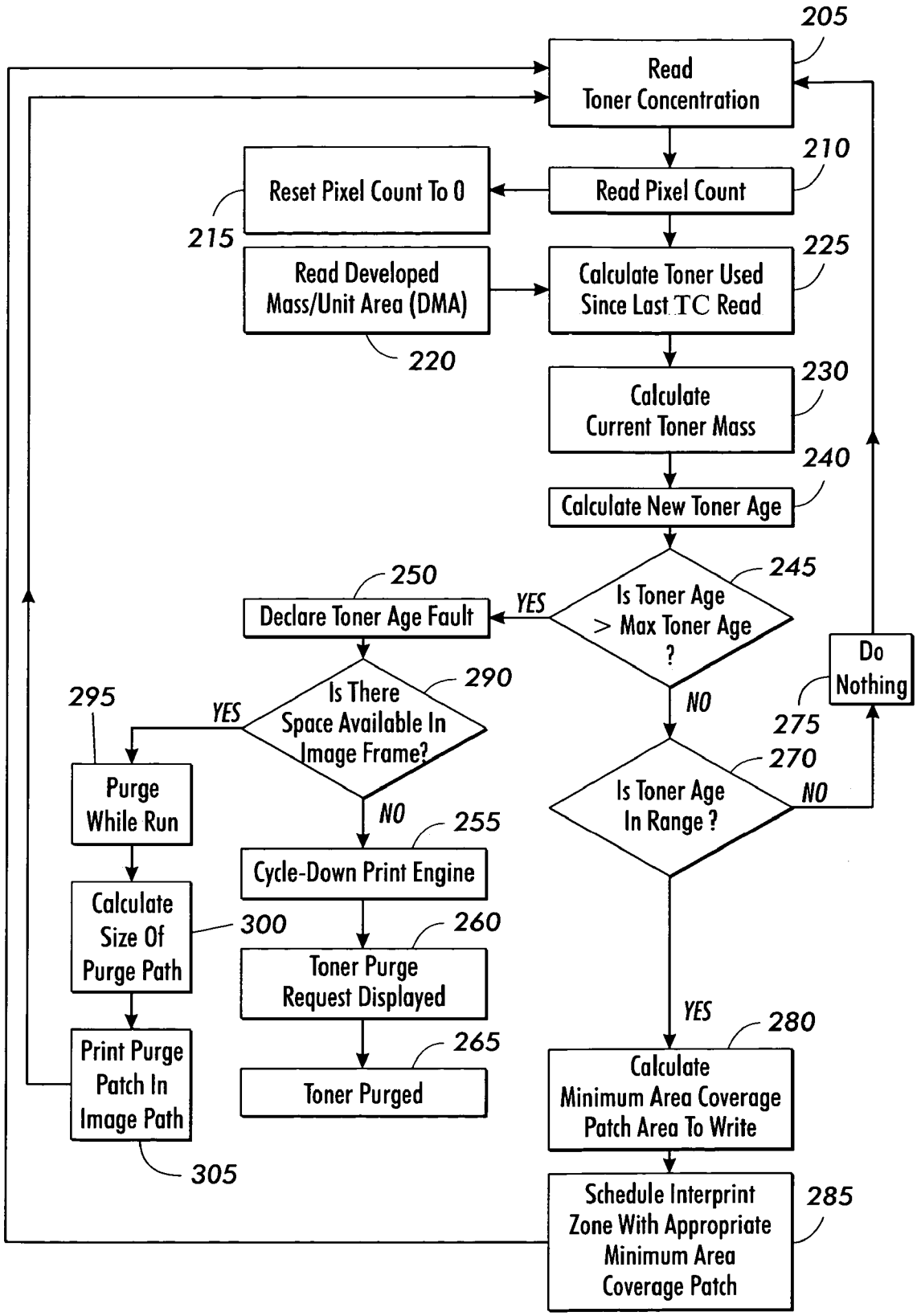
FIG. 2 is a flow chart showing the toner age calculation and the utilization of purge while run process of the present invention.

Now referring to FIG. 2 which is a flow chart showing the process that calculates toner age and takes appropriate action based upon the results of the toner age calculation. Preferably, the control unit 30 reads the toner concentration (TC) every n seconds, wherein n is a positive number, and this number is stored in memory (step 205). The control unit 30 reads the pixel count (step 210), and the pixel counter is reset to zero (step 215). The control unit 30 reads the developed mass per unit area (DMA), sensed by mass sensor 110, and stores the DMA in memory (step 220). The control unit 30 calculates the toner amount used since the last toner concentration was read (step 225) by using the DMA stored in memory.

Subsequently, the current toner mass in developer unit 90 is calculated by control unit 30 (step 230) by using the following formula:

$$\text{Current Toner Mass}=(\text{toner concentration}/100)*\text{carrier mass} \quad \text{(Equation 2)}$$

The carrier mass varies depending upon the print engine, and is generally determined by the manufacturer based on a number of factors including size of print engine, toner stability, speed of print engine, etc.

Then, the new toner age is calculated by the control unit 30 (step 240) using the following formula:

$$\text{New Toner Age}=[(\text{Current Toner Mass}-\text{Toner Used})*(\text{Previous Toner Age}+n\ \text{seconds}*\text{prints/second})]/\text{Current Toner Mass} \quad \text{(Equation 3)}$$

After the new toner age is calculated, the new toner age is compared to a predetermined maximum toner age, which is based on the appearance of image defects (step 245). An image is considered defective when the quality of the image does not meet predetermined customer, user or manufacturer print quality standards. If the current toner age is greater than the maximum toner age, then the control unit 30 recognizes a toner age fault (step 250). Print controller determines if a sufficient sized purge patch can be generated in an unused image area of an image frame (step 290). If not then the controller interrupts the current job (step 255). If a purge patch can be generated then the size of the control patch is determined (step 300) and the purge patch is printed along with the current job (305). The inline purge routine (also known as purge while run) creates patches in the unused area of the customer image panel increasing the material throughput in the system. The increase in material throughput is sufficient such that most of the problems associated with extended runs of low area coverage are mitigated without the need to call the auto toner purge routine, thereby significantly improving system productivity. The ability to selectively place patches in the customer image area increases the amount of space available for control patches and enables a significant improvement in productivity. Preferably, the system uses the MAC patch and the purge while run capability for all situations under which the customer's job and image content enables the purge while run capability to execute. Under the circumstances in which the customer's job and image content do not allow for purge while run to execute, then the system will need to call upon the auto toner purge capability via a system dead cycle. When the toner age decreases the system moves back to step 205.

During the course of a print job, a toned purge patch is printed in the area on the image panel that is not used by the customer image. At least two possibilities exist: When a customer is running images that less than the maximum process width, there is area on the inboard side of the photoreceptor belt that is available for writing a toned image to maintain toner throughput. A second possibility is when a print job is utilizing a 4-pitch mode there is considerable space on the trailing edge of the document for writing a toned image to maintain toner throughput. In this pitch mode, the patch size could be independent of customer image width. This is a desirable to have capability that allows the customer to run on large paper for multiple-ups without having to rely on auto toner purge.

Returning back to FIG. 2, if there is no space for a purge patch then the print engine, then the system will raise a machine condition (fault) and automatically enter a toner purge routine when the toner age exceeds the toner purge routine threshold. The toner age continues to be recalculated during the toner purge routine, as in run-time, except that during the purge routine an out-of-range toner age does not trigger a fault. The toner purge routine decreases the toner age, for example, by running a high area coverage image. At the end of the toner purge routine, the operator may reinitiate the interrupted job.

If the new toner age is less than the predetermined maximum toner age, then the new toner age is compared to a predetermined toner age range (step 270). If the new toner age is less than a predetermined minimum toner age in the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a minimum area coverage (MAC) patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

Figure 3:
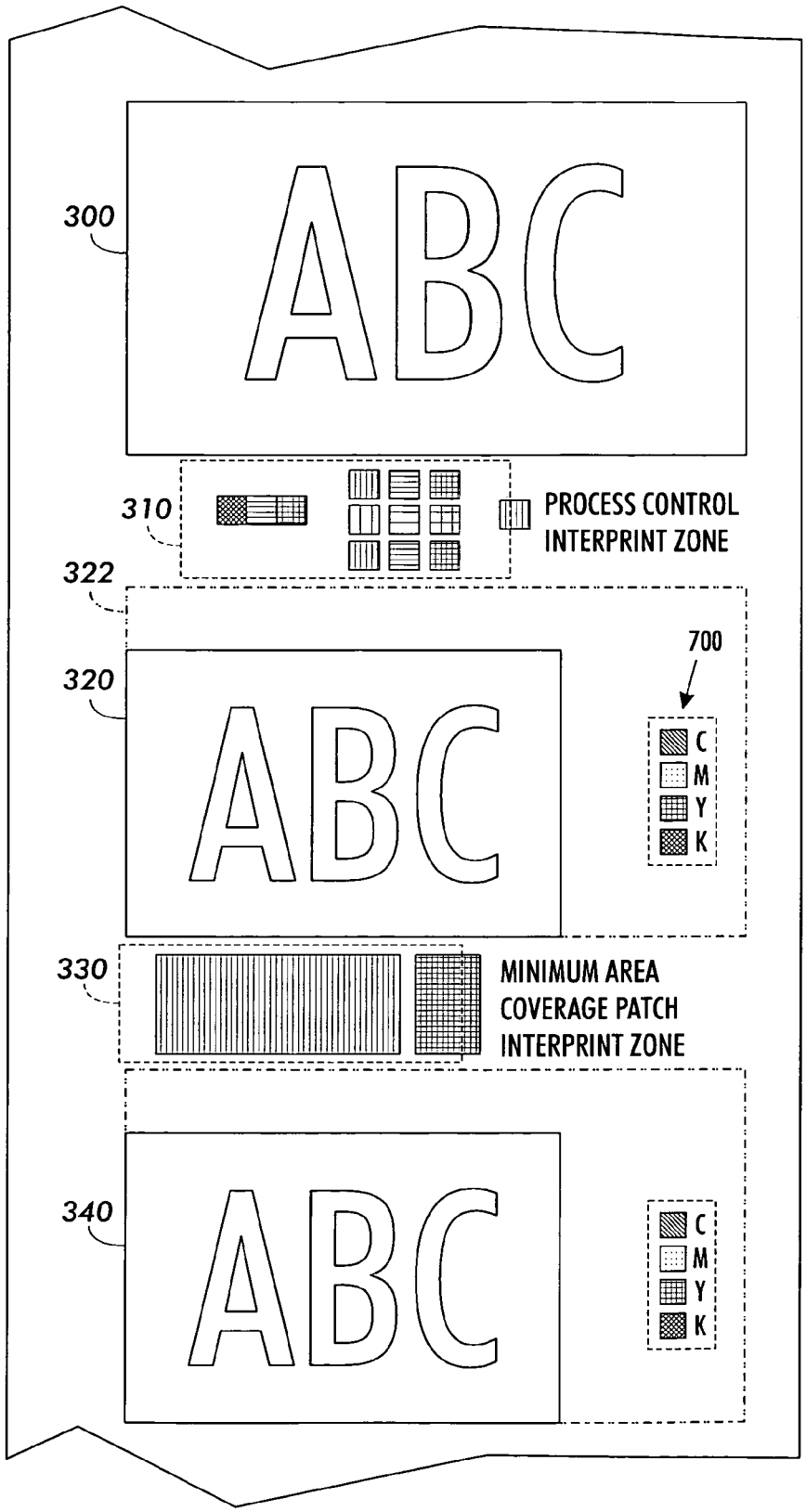
FIG. 3 is a layout showing one implementation of customer images, process control patches, MAC patches and purge patches on a photoreceptor.

FIG. 3 shows examples of a layout of customer images, process control patches, MAC patches and purge patches on a photoconductive surface (e.g. surface of photo receptive belt 50) over time. A print zone on the surface dedicated to the customer image 300 is followed by an interprint zone 310 in which control patches are laid out to be read by electrostatic or development sensors. Another customer image within image frame 320 is laid out, followed by an interprint zone 330 in which one or more MAC patches are laid out, for the purpose of maintaining toner age. Purge patches are laid out in unused portion of the customer image frame 320. In FIG. 3, the MAC patch. interprint zone 330 contains patches for two different colors. The MAC patch interprint zone is followed by another customer image 340. Purge patches are laid out in unused portion of the customer image within image frame 340 purge patches can be two different colors. It is understood that FIG. 3 is just one example of the many different types of layouts that can be utilized.

Example of purge patches that could be used in the commercially available IGEN3® printing press manufactured by Xerox Corporation. Considering images widths 12" and less developed on the imaging surface of the photoreceptor belt. The 10 pitch mode image panel is approx. 228 mm×364 mm. If one leaves a 3 mm space between the customer image and the patch area to account for registration tolerance, etc, and a 3 mm on the LE and TE of the patch, this leaves a patch size of approximately 56 mm×222 mm. This equates to an area coverage of ~16% for writing the purge while run patches. This would allow ~4% per color; with a patch size of approximately 56 mm wide by 50 mm long). This is close to the area coverage (including MAC Patch) at which low area coverage problem is mitigated. The patch size can be scale by the print controller in the process direction for the other pitch modes. For instance in 5 pitch mode the patch size would automatically scale to 56 mm wide by 100 mm long.

Figure 4:
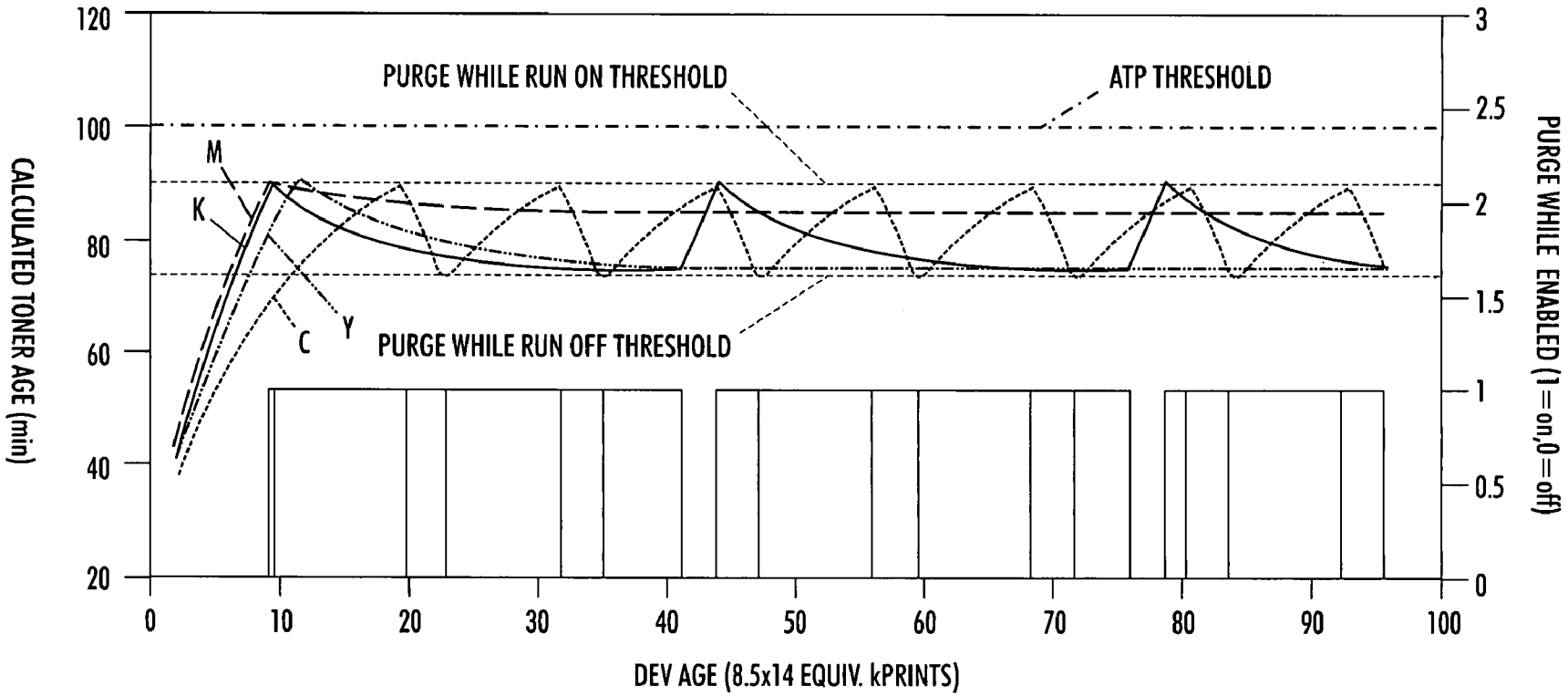
FIG. 4 is experimental data of printing machine of the type of shown in FIG. 1 employing principles of the present invention.

The principles of the invention were tested in an IGEN3® Machine manufactured by Xerox Corporation. FIG. 4 illustrates test results from four developer housings when single layer color patches are run in the non-image area of each panel for pages up to 12" wide. PWR adds a maximum of ~4% AC to each panel, based on an 8.5×14 page. Two pass cleaning is provided for image sizes>12" when job streaming. Each pitch mode has a unique set of patches PWR is triggered at TPTonerAge#=90 min., and turns off at a set value below the trigger point (presently set to 20 min.) Only scheduled when ATA (transfer overdrive) is OFF.

In the IGEN3® implementation, the three means to control toner age (MAC patch, PWR, and toner purge) have been integrated into a system control system. This is accomplished by carefully selecting the thresholds at which each toner age control element is enabled. In the IGEN3® implementation, the MAC patch capability threshold is lower than the purge while run thresholds, which in turn is lower than the toner purge threshold. This approach maximizes the system lower area coverage performance while minimizing the impact to customer productivity. FIG. 4 illustrates a system level implementation where the PWR threshold is set trigger PWR patches at a lower toner age than the toner purge routine (ATP) threshold.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. A method controlling toner age in a developer housing comprising:

recording a latent image in a predefined image frame on an imaging surface generating a purge patch in an unused portion of said predefined image frame; and generating an inline purge signal to initiate generating of said purge patch, said recording includes scaling the purge patch to fit in the used portion of said predefined image frame.

2. The method of claim 1, further comprising activating or inactivating the generating of the purge patch based upon an amount of unused portion of said image frame.

3. The method of claim 2, further comprising providing a maximum toner age in a memory;

reading toner concentration in the developer housing and storing toner concentration in the memory;

reading pixel count from a pixel counter, which has the pixel count of a digital image;

reading and storing developed mass per unit area in the memory;

determining toner age in the developer housing based upon the toner concentration, pixel count and developed mass per unit area; and activating a toner purge mode in a print job when the toner age is greater than a maximum toner age.

4. The method of claim 3, further comprising interrupting a print job when the toner age is greater than a maximum toner age; and purging the toner in the developer housing to reduce the toner age in the developer housing, if the recording of the purge patch is inactivated.

5. The method of claim 3 wherein said toner purge mode includes generating said purge patch.

6. The method of claim 3 wherein said toner purge mode includes generating a MAC patch.

7. The method of claim 3 wherein said toner purge mode includes generating a MAC patch and said purge patch.

8. An electrostatic printing machine having a plurality of color stations having a system for producing control patches wherein said system employs a method for reducing toner usage in producing said control patches comprising:

reviewing a print job comprising job images;

performing a pixel count for each color plane on a sheet level of the print job;

converting the pixel count to a percent area coverage per color plane;

in feed-forward mode comparing the area coverage per color plane to a reference value;

activating or inactivating a color station depending on the comparison of the area coverage per color plane to the reference value; and printing a MAC patch or an optional purge patch with said color station if the area coverage per color plane is substantially less than a reference value.

9. The method of claim 8, further comprising generating an inline purge signal to initiate generating of said purge patch.

10. The method of claim 8, wherein said recording said purge patch includes scaling the purge patch to fit in an unused portion of a predefined image frame.

11. The method of claim 10, further comprising activating or inactivating the generating of the purge patch based upon an amount of unused portion of said image frame.

12. The method of claim 11, further comprising providing a maximum toner age in a memory;

reading toner concentration in a developer housing and storing toner concentration in the memory;

reading pixel count from a pixel counter, which has the pixel count of a digital image;

reading and storing developed mass per unit area in the memory;

determining toner age in the developer housing based upon the toner concentration, pixel count and developed mass per unit area; and activating a toner purge mode in a print job when the toner age is greater than a maximum toner age.

13. The method of claim 12, further comprising interrupting a print job when the toner age is greater than a maximum toner age; and purging the toner in the developer housing to reduce the toner age in the developer housing, if the recording of the purge patch is inactivated.

14. The method of claim 12 wherein said toner purge mode includes generating said purge patch.

15. The method of claim 12 wherein said toner purge mode includes generating a MAC patch.

16. The method of claim 12 wherein said toner purge mode includes generating a MAC patch and said purge patch.

* * * * *